US005205561A

United States Patent [19]

Lux

[11] Patent Number: 5,205,561

[45] Date of Patent: Apr. 27, 1993

[54] GOLF CLUB

[76] Inventor: Michael S. Lux, P.O. Box 508, Twin Lakes, Wis. 53181

[21] Appl. No.: 796,862

[22] Filed: Nov. 25, 1991

[51] Int. Cl.[5] ..... A63B 69/36

[52] U.S. Cl. ..... 273/186.2; 273/193 B; 273/77 A; 33/508

[58] Field of Search ..... 273/193 B, 187.4, 77 A, 273/193 R, 186.2, 77 R, 80 B; 33/508

[56] References Cited

U.S. PATENT DOCUMENTS

| | | | |
|---|---|---|---|
| 2,497,237 | 2/1950 | Reineking | 273/193 B |
| 3,033,575 | 5/1962 | Hause | 273/193 B |
| 4,854,585 | 8/1989 | Koch et al. | 273/193 B |

*Primary Examiner*—George J. Marlo
*Attorney, Agent, or Firm*—Tod R. Nissle

[57] ABSTRACT

A golf club in which the head of the club is hinged to the shaft such that the head breaks or pivots rearward with respect to the shaft when, during a golf swing, the club does not follow a prescribed path of travel or the club is improperly rotated. The hinge includes two pair of contact surfaces which absorb and distribute forces when the hinge closes and the contact surfaces strike one another. The specific position of the hinge in the handle of a golf club varies depending on the loft of the club utilized. The specific positioning of the hinge in the handle of a club in relation to the loft of the club head is critical in insuring that the hinge breaks at appropriate points during a golf swing.

4 Claims, 4 Drawing Sheets

FIG. 6
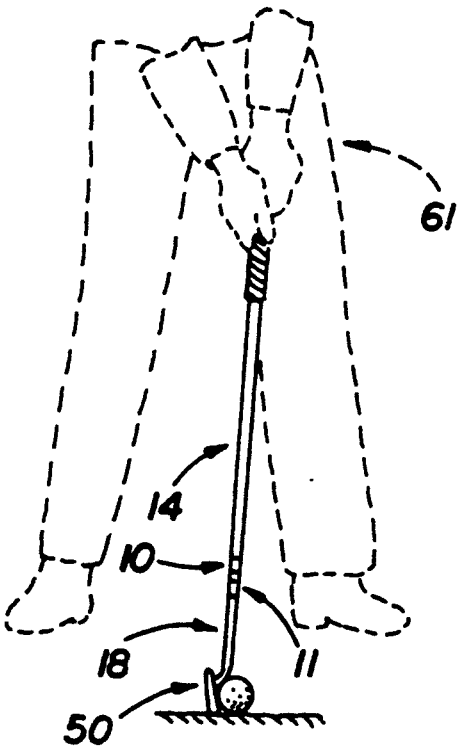
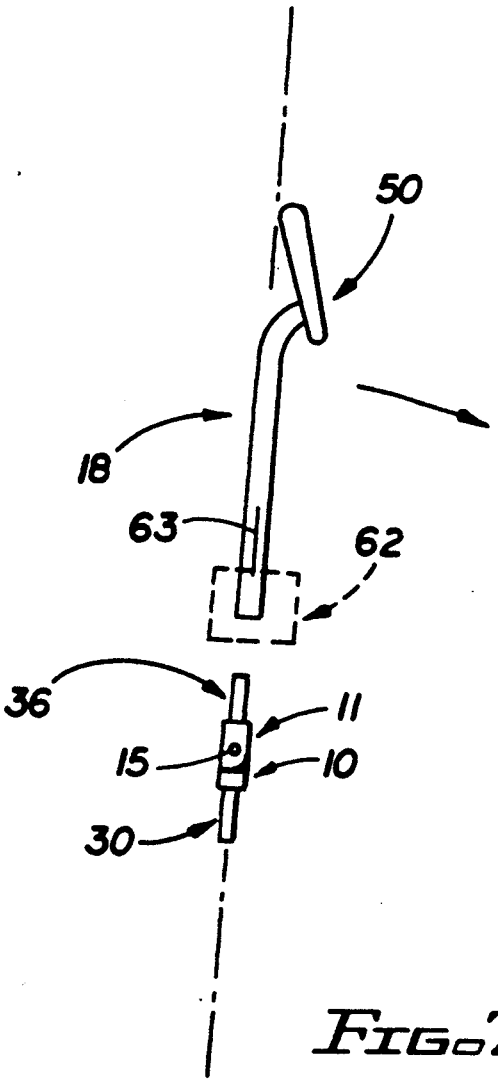
FIG. 7

FIG. 8
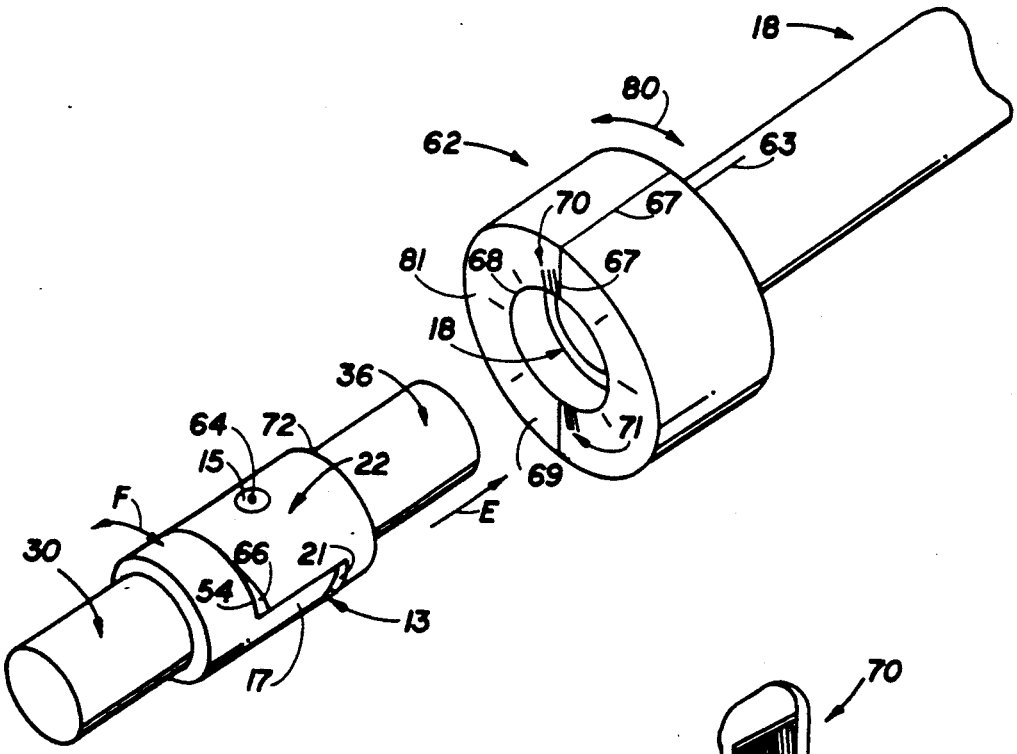
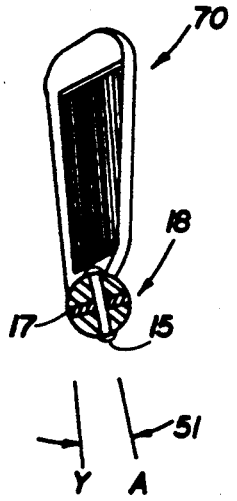
FIG. 9

GOLF CLUB

This invention pertains to golf apparatus.

More particularly, the invention relates to a golf club in which the head of the club is hinged to the shaft such that the head breaks or pivots rearwardly with respect to the shaft when, during a golf swing, the club does not follow a prescribed path of travel or the club is improperly rotated.

In another respect, the invention relates to a set of golf clubs of the type described in which the amount of deviation from the proper arc of travel or from the prescribed amount of club rotation which is required to cause the club head to break or pivot rearwardly with respect to the club shaft varies depending on the loft of club used and depending on the arc of travel of the club during a golf swing.

A number of golf clubs which pivotally attach the head of the club to the club shaft are known in the art. See, for example, U.S. Pat. Nos. 4,854,585 to Koch et al., 3,033,575 to Hause, 2,497,237 to Reineking, 3,170,690 to Goranson et al., 2,159,579 to Whitney and 4,889,343 to Nielsen. Such prior art golf clubs suffer from certain disadvantages. First, the hinge mechanisms used in the clubs each include stop surfaces which prevent the club head from pivoting in a certain direction or from pivoting past a selected point. These stop surfaces are relatively small and prone to deformation or breakage during prolonged use of the clubs. Second, prior art hinge mechanisms do not compensate for changes in the path of travel of a club which occurs when clubs having differing lofts are utilized. When clubs of differing lofts are utilized, the recommended arc of travel and amount of rotation of the club during use of the club to strike a golf ball varies. Third, some prior art hinge mechanisms cause the head of a golf club to pivot forwardly, which make the club unsuitable for use in playing a game of golf.

Accordingly, it would be highly desirable to provide an improved hinged golf club which would more effectively distribute forces generated during utilization of the golf club to minimize the likelihood that the hinge mechanism will be damaged or broken.

It would also be high desirable to provide a set of hinged golf clubs each having a club face with a different loft, and each having a hinge mechanism adapted to permit the club head to break with respect to the club shaft when the club is rotated an amount which is different from the amount of rotation required to cause the hinge mechanism on the remaining clubs to break during a golf swing.

Therefore, it is a principal object of the invention to provide an improved golf club.

Another object of the invention is to provide an improved golf club which includes a hinge mechanism that permits the club head to break with respect to the shaft when, during a golf swing, the club moves through an incorrect arc of travel or is rotated an improper amount.

A further object of the invention is to provide an improved golf club of the type described which better distributes through the golf club vibrational and torque forces generated by the hinge mechanism when the head of the club breaks with respect to the club shaft.

Still another object of the invention is to provide a set of hinged golf clubs which each include a club head having a different loft and which each include a hinge mechanism that permits the club head to break when the club is rotated a selected amount during a golf swing, the amount of rotation required to cause the hinge mechanism to break differing for each club.

These and other, further and more specific objects of the invention will be apparent to those skilled in the art from the following detailed description thereof, taken in conjunction with the drawings, in which:

FIG. 6 is an elevation view illustrating the hinge mechanism of the invention interposed in the shaft of a golf club;

FIG. 7 is a top view illustrating a method and calibrated tool utilized to install the hinge mechanism of the invention in the shaft of a golf club;

FIG. 8 is an exploded perspective assembly view further illustrating the use of the calibrated tool of FIG. 7 in installing the hinge mechanism of the invention along the shaft of a golf club; and FIG. 9 is a top view of the head and lower portion of a two iron having a hinge mechanism constructed in accordance with the invention.

Figure 1:
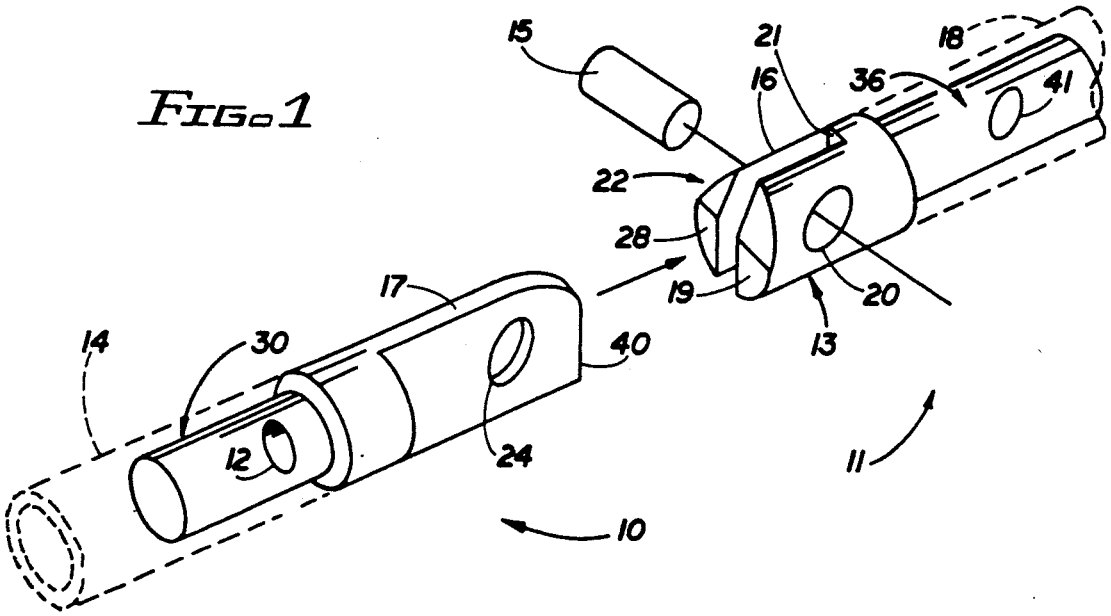
FIG. 1 is a perspective view illustrating a hinge mechanism utilized in a golf club constructed in accordance with the principles of the invention.

Briefly, in accordance with my invention, I provide an improved golf club. The club includes a head at the lower end thereof provided with a face on its forward side; a grip at the upper end thereof; a shaft having a longitudinal axis and interconnecting the head and the grip; and, a hinge interposed in the shaft and dividing the shaft into two portions and including first and second hinge members. The first hinge member is fixed to one of the shaft portions. The second hinge member is fixed to the other of the shaft portions. A hinge pin pivotally connects the first and second hinge members. The first hinge member includes an outer end spaced to one side of the hinge pin; a shoulder spaced to the other side of the hinge pin and generally normal to the longitudinal axis of the shaft; and, a flat surface on the outer end. The second hinge member includes an outer end spaced to the other side of the hinge pin; a shoulder spaced to the one side of the hinge pin and engageable with the flat surface of the first hinge member; and, a flat surface on the outer end of the second hinge member and engageable with the shoulder of the first hinge member. The flat surfaces of the hinge members permit the pivotal movement of the head about the hinge pin in a first direction and bear against the shoulders to prevent movement of the head about the hinge pin in a second direction opposite the first direction.

In another embodiment of my invention, I provide improved golf apparatus which includes first and second clubs of differing loft. The first club includes a grip at the upper end thereof; a head at the lower end thereof and provided with a face on its forward side, the face having a selected loft and including a lower ground engaging edge; a shaft having a longitudinal axis and interconnecting the grip and the head, the edge and longitudinal axis generally lying in a common plane; and, a hinge interposed in the shaft and dividing the shaft into two portions. The hinge includes first and second hinge members and a hinge pin pivotally connecting the hinge members. The first hinge member is attached to one of the shaft portions. The second hinge member is attached to the other shaft portion. The hinge pin is at a first selected angle with respect to the common plane. The first hinge member includes an outer end to one side of the hinge pin. The second hinge member includes a shoulder to the one side of the hinge pin and engageable with the outer end to prevent the pivotal movement of the head about the hinge pin in a first direction and to allow the pivotal movement of the head about the hinge pin in a second direction opposite the first direction. The second club includes a grip at the upper end thereof; a head at the lower end thereof and provided with a face on its forward side, the face having a selected loft and including a lower ground engaging edge; a shaft having a longitudinal axis and interconnecting the grip and the head, the edge and longitudinal axis generally lying in a common plane; and, a hinge interposed in the shaft and dividing the shaft into two portions. The hinge of the second club includes first and second hinge members and a hinge pin pivotally connecting the hinge members. The first hinge member of the second club is attached to one of the shaft portions of the second club. The second hinge member of the second club is attached to the other shaft portion of the second club. The hinge pin of the second club is at a first selected angle with respect to the common plane of the second club. The first hinge member of the second club includes an outer end to one side of the hinge pin of the second club. The second hinge member of the second club includes a shoulder to the one side of the hinge pin of the second club and engageable with the outer end of the second club to prevent the pivotal movement of the second club head about the hinge pin of the second club in a third direction and to allow the pivotal movement of the second club head about the hinge pin of the second club in a fourth direction opposite the third direction.

Turning now to the drawings which depict the presently preferred embodiment of the invention for the purpose of illustrating the practice thereof and not by way of limitation of the scope of the invention and in which like reference characters refer to corresponding elements throughout the several views, FIG. 1 illustrates a golf club hinge mechanism constructed in accordance with the invention and adapted to be interposed between the upper 14 and lower 18 portions of the shaft of a golf club. Portion 18 extends from the hinge mechanism to the head of the golf club. Portion 14 extends from the hinge mechanism to the handle of the golf club. The hinge mechanism includes upper hinge member 10 and lower hinge member 11. Cylindrical neck 30 is slidably received in hollow portion 14 and secured in portion 14 by a pin (not shown) which passes through portion 14 and through aperture 12 formed through neck 30. Panel-shaped tongue 17 extends outwardly from semicircular, flat shoulders 54 of member 10. A shoulder 54 is on either side of tongue 17. Aperture 24 is formed through tongue 17. Flat elongate surface 40 is formed on the distal or outer end of tongue 17.

Cylindrical neck 36 of lower hinge member 11 is slidably received in hollow portion 18 and secured in portion 18 by a pin (not shown) which passes through portion 18 and through aperture 41 formed through neck 36. Jaws 13, 22 extend outwardly from flat, planar shoulder 21 of member 11. Apertures 20 are formed through jaws 13, 22. Flat surfaces 19, 28 are formed on the distal or outer ends of jaws 13, 22, respectively. Shoulders 21, 54 and flat surfaces 19, 28, 40 are perpendicular to the longitudinal axis L of portions 14, 18 and of necks 30 and 36. Flat surface 65, 66 cant or slope away from shoulders 54.

After tongue 17 is slid between jaws 13 and 22 in the direction of arrow 55, pin 15 is slidably inserted through apertures 20 and 24 to pivotally interconnect tongue 17 intermediate jaws 13, 22. Pin 15 includes heads (not shown in FIG. 1) attached to either end of pin 15 to prevent pin 15 from slipping out of apertures 20 and 24.

Figure 2:
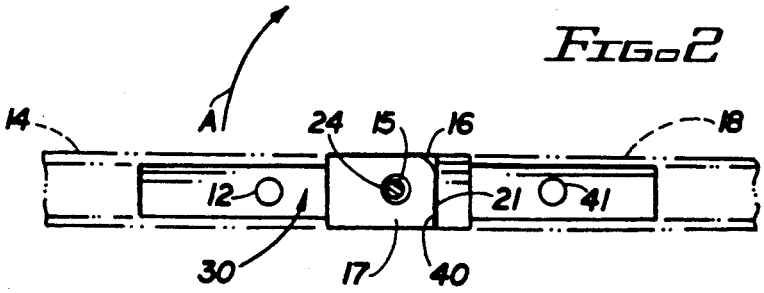
FIG. 2 is a side view of the hinge mechanism of FIG. 1 illustrating the mode of operation thereof.

FIG. 2 illustrates the hinge mechanism of FIG. 1 after tongue 17 is slid intermediate jaws 13, 22 in the direction of arrow 55 and pin 15 is inserted through apertures 20 and 24. In FIG. 2, jaw 13 is omitted for the sake of clarity. As indicated in FIG. 2, portion 14 can, when portion 18 is held stationary, be pivoted about pin 15 in the direction of arrow A. Flat surface 40 bears, however, against shoulder 21 and prevents the pivoting of portion 14 about pin 15 in the direction of arrow G.

Figure 3:
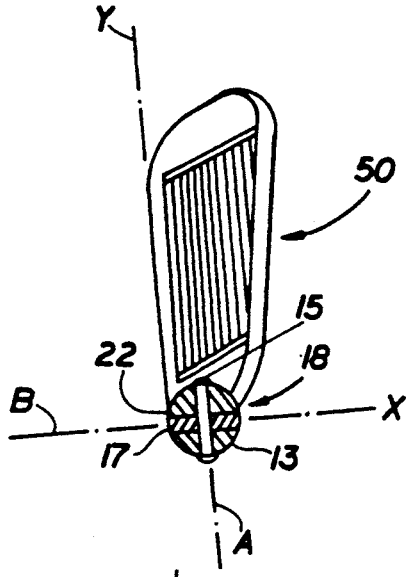
FIG. 3 is a top view of the head and lower portion of a golf club having a hinge mechanism constructed in accordance with the invention.

The hinge mechanism of FIGS. 1 and 2 is preferably interposed in the shaft of a golf club in the manner shown in FIG. 3 a few inches from the head of the club. FIG. 3 is section view of a golf club illustrating the head and lower end of the shaft of the club and taken along section line 3—3 of FIG. 2. In FIG. 3, head 50 is the head of a five iron. Head 50 includes a lower ground engaging edge 56 which lies along imaginary axis Y. Edge 56 also generally lies in a common vertically oriented plane with the longitudinal axis the shaft of the golf club. In FIG. 3 the longitudinal axis of the shaft of the golf club extends outwardly from and is at an angle to the plane of the sheet of paper of the drawings. The longitudinal axis A of pin 15 is parallel to axis Y. Imaginary axis X is perpendicular to axis Y and lies in the plane of the sheet of paper comprising the drawings. The imaginary horizontal axis B passes through tongue 17 and is parallel to the flat planar side surfaces 57, 58 (FIG. 1) of tongue 17. Axis B is parallel to imaginary axis X, and, in FIG 3, lies above the plane of the paper of the drawings. Face 60 of the club in FIG. 3 opens, as do the faces of all the iron and wood golf clubs, forwardly toward the direction of travel to be followed by a golf ball struck with the club. Though not visible in FIG. 3, curved portion 59 of tongue 17 faces rearwardly in a direction opposite the direction of face 60. Consequently, during the back swing of the club, portion 18 and head 50 can pivot or break in the direction of arrow C (FIG. 2) but can not break in the direction of arrow D. Portion 18 can not break in the direction of arrow D because flat surfaces 19, 28 bear against shoulder 54 and flat surface 40 bears against shoulder 21. Similarly, after portion 18 has pivoted about pin 15 in the direction of arrow C and then rotates about pin 15 in the direction of arrow D and back to the position of FIG. 2, shoulder 21 contacts flat surface 40 and flat surfaces 19, 28 contact shoulder 54 to halt the pivoting movement of portion 18 about pin 15. Flat surfaces 19, 28, 40 simultaneously each contact their opposing shoulders to halt the pivoting movement of portion 18 in the direction of arrow D. Since shoulders 54 are located on the side of pin 15 which is opposite the side of pin 15 on which shoulder 21 is located, the vibrational forces produced when portion 18 pivots in the direction of arrow D back to the normal operative position of portion 18 in FIG. 2 tend to counterbalance. The vibrational forces produced to one side of pin 15 by flat surfaces 19, 28 and shoulders 54 tend to counterbalance the vibrational forces produced on the other side of pin 15 by surface 40 and shoulder 21.

In the practice of the invention, the hinge mechanism is interposed along the club shaft such that the angle 51 between axes A and Y is a specified amount depending on the club used. As the loft of the club head changes, i.e., as the number of club changes, the magnitude of angle 51 also can vary. This variance in the magnitude of angle 51 is critical in the practice of the invention, because the arc of travel of the club and, possibly, the amount of rotation of the club permissible during the swing of the club, varies depending on the loft of the head of the club.

When the hinge mechanism of the invention is installed in the shaft of a five iron in the orientation of FIG. 3, the pivoting of portion 18 about pin 15 is relatively easily accomplished during the back swing of the club. In other words, a small amount of undesired rotation of the club or a small deviation of the club from the desired arc of travel during the golf club swing will cause portion 18 to pivot about pin 15 in the direction of arrow C in FIG. 2. The hinge mechanism of FIG. 2 is interposed in the shaft of the golf club so that if head 50 breaks during the swing of the club, head 50 breaks rearwardly. In FIG. 6, if head 50 and shaft portion 18 were pivoted rearwardly while shaft portion 14 remained in fixed position, head 50 and shaft portion 18 would pivot about pin 15 toward the right foot of the golfer indicated in dashed outline 61. This "rearward" break of the club is important because it enables the club to more readily be utilized to play a game of golfer. Many so-called "training" golf clubs cannot be used to play a game of golf because the head breaks forwardly during the swing of the golf club.

Figure 4:
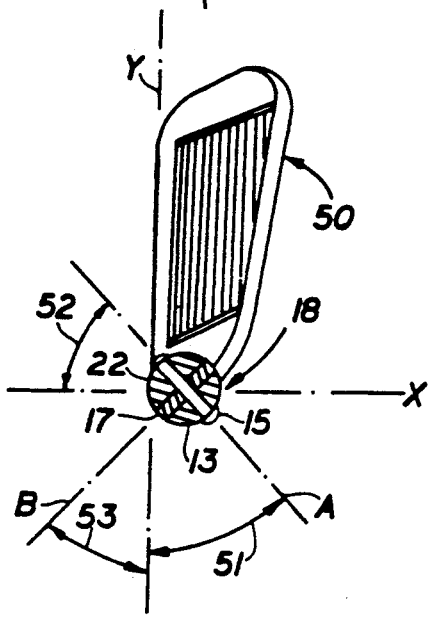
FIG. 4 is a top view of the head and lower portion of a golf club having a hinge mechanism constructed in accordance with the invention.

When the hinge mechanism of the invention is installed in the shaft of a five iron in the orientation of FIG. 4, the pivoting of portion 18 about pin 15 is very easily accomplished during the back swing of the club. A very small amount of undesired rotation or a very small deviation of the club from the back swing will cause portion 18 to pivot about pin 15 in the direction of arrow C in FIG. 2. The orientation of the hinge mechanism shown in FIG. 4 is undesirable because it is nearly impossible for a golfer to swing the club without causing portion 18 to break and pivot about pin 15 in the direction of arrow C.

Figure 5:
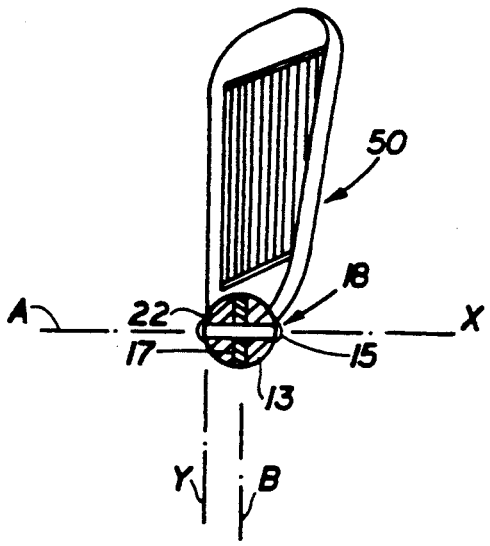
FIG. 5 is a top view of the head and lower portion of still another golf club having a hinge mechanism constructed in accordance with the invention.

When the hinge mechanism of the invention is installed in the shaft of a five iron in the orientation of FIG. 5, the pivoting of portion 18 about pin 15 is very difficult to accomplish during the back swing of the club. A large amount of undesired rotation or a large deviation of the club from the back swing will cause portion 18 to pivot about pin 15 in the direction of arrow C in FIG. 2. The orientation of the hinge mechanism shown in FIG. 4 is undesirable because it is nearly impossible for a golfer to swing the club along an improper arc of travel which will cause portion 18 to break and pivot about pin 15 in the direction of arrow C.

The preferred magnitudes of angle 51 in FIG. 3 are summarized below in TABLE I.

TABLE I

| Golf Club | Angle 51 (Degrees) |
|---|---|
| One wood | 0.00 |
| Two wood | 0.00 |
| Three wood | 0.00 |
| Four wood | 0.5 to 1.5 |
| Five wood | 0.5 to 2.0 |
| One iron | 0.00 |
| Two iron | 0.5 to 1.5 |
| Three iron | 0.5 to 2.0 |
| Four iron | 1.5 to 2.5 |
| Five iron | 1.7 to 3.5 |
| Six iron | 2.5 to 5.5 |
| Seven iron | 5.0 to 6.5 |
| Eight iron | 6.0 to 8.5 |
| Nine iron | 8.0 to 10.5 |
| Pitching wedge | 10.0 to 14.0 |

Installation of the hinge mechanism of the invention is illustrated in FIGS. 7 and 8. In FIG. 7, the head 50 and lower portion 18 of the shaft of a golf club are held in fixed position by a vice, clamp or other conventional means not illustrated in FIG. 7. A calibration tool 62 is slid over the hollow distal end of portion 18 to the position generally indicated by dashed lines 62 in FIG. 7 and illustrated in FIG. 8. Neck 36 is slid into the hollow distal end of portion 18 until the circular shoulder 72 of the hinge mechanism contacts the end of portion 18. Tool 62 is slidably rotated about the distal end of portion 18 in the directions indicated by arrows 80 until calibration line 67 aligns with line 63 or with some other reference point on portion 18 or club head 50. Line 63 lies in the common reference plane which passes through the edge 56 and the longitudinal axis of the shaft of the club. A set screw (not shown) extending through tool 62 is tightened against portion 18 or some other means is utilized to removably secure tool 62 on portion 18 in the position shown in FIG. 8 with lines 63 and 67 in colinear relationship. Neck 36 is slid in the direction of arrow E into the hollow distal end of portion 18 until the circular shoulder 72 of the hinge mechanism contacts the circular end or lip of portion 18. The inner diameter of opening 68 is slightly larger than the outer diameter of shoulder 72 such that shoulder 72 and the portions of jaws 13, 22 terminating at should 21 and adjacent should 72 are slidably received in cylindrical opening 68. The inner diameter of potion 18 is slightly larger than the outer diameter of neck 36 such that neck 36 is slidably received in the distal end of portion 18. Once neck 36 is slid into the distal end of portion 18 and shoulder 72 abuts the circular end or lip of portion 18, the reference point 64 on pin 51 is adjacent indicia 67, 70 formed on the circular face 81 of calibration tool 62. In FIG. 8, calibration mark 67 is the "0 degree" calibration mark. The calibration marks 70 to the left of mark 67 in FIG. 8 ascend in value as the distance of the mark from mark 67 increases. For example, the calibration mark 70 nearest mark 67 could have a value of one degree; the calibration mark next farthest from mark 67 could have a value of two degrees; the calibration mark next farthest from mark 67 5 could have a value of three degrees; etc. The purpose of marks 67, 70 is to indicate how far reference point 64 is rotated from mark 57 in a conventional 360 degree full revolution circle. After neck 36 is slid into the distal end of portion 18, the hinge mechanism is rotated in the directions indicated by arrow F until the desired angle 51 is obtained between the longitudinal axis A of pin 15 and the common reference plane extending through the lower edge of the face of the golf club and the longitudinal axis L of the shaft. For example, if the club head were a five iron, then, as noted in TABLE I, the desired angle would be in the range of 1.7 to 3.5 degrees, and the hinge mechanism would be rotated until the reference point 64 was aligned with a calibration mark 70 which indicated 1.7 to 3.5 degrees. Once reference point 64 is aligned with the appropriate calibration mark 70 on tool 62, a hole is drilled through portion 18 and neck 36 and a pin is secured in the hole to attach the hinge mechanism to lower portion 18 and fix the angle between pin 15 and the common reference plane. After neck 36 is fixedly connected to portion 18, tool 62 is slid off of portion 18 and the hinge mechanism and the hollow distal end of portion 14 is slid onto neck 30 and fixedly attached thereto. FIG. 6 illustrates a club after the hinge mechanism has been interposed therein in the manner described above. As would be appreciated by those of skill in the art, calibration tool 62 can take on any shape and dimension and be placed in any desired position adjacent portion 18 as long as the tool 62 enables the hinge mechanism to be accurately rotated in the direction of arrow F to position pin 15 such that there is a desired angle between the longitudinal axis of pin 15 and the common reference plane passing through edge 62 and the axis of the club shaft. Any desired mean can be utilized to fixedly secure the hinge mechanism to portions 14, 18 after pin 15 is rotated to a desired position. Means other than necks 30 and 36 can be utilized to affix the hinge mechanism to portions 14, 18. For example, neck 36 could be hollow and slip over portion 18 instead of inside of portion 18.

FIG. 9 is a top view of the head and lower portion of a two iron 70 provided with a hinge mechanism constructed in accordance with the invention.

Having described my invention in such terms as to enable those skilled in the art to understand and practice the invention, I claim:

1. A golf club including (a) a head at the lower end thereof provided with a face on its forward side;

(b) a grip at the upper end thereof;

(c) a shaft having a longitudinal axis and interconnecting said head and said grip; and (d) a hinge interposed in said shaft and dividing said shaft into two portions and including (i) first and second hinge members, said first hinge member being fixed to one of said shaft portions, said second hinge member being fixed to the other of said shaft portions, and (ii) a hinge pin (15) pivotally connecting said hinge members;

said first hinge member including an outer end spaced to one side of said hinge pin;

a flat shoulder (54) spaced to the other side of said hinge pin; and, a flat surface (40) on said outer end;

said second hinge member including an outer end spaced to the other side of said hinge pin;

a flat shoulder (21) spaced to said one side of said hinge pin (15) to contact said flat surface (40) of said first hinge member, said surface (40) and shoulder 21 being generally normal to the longitudinal axis of said shaft when contacting one another; and, a flat surface (19) on said outer end of said second hinge member, to contact said shoulder (54) of said first hinge member, said surface 19 and shoulder 54 being generally normal to the longitudinal axis of said shaft when contacting one another, said first and second hinge members being movable between two operative positions, a first operative position with said flat surfaces (19) (40) simultaneously bearing against and contacting said shoulders (54) (21) to prevent movement of said head about said hinge pin (15) in a first direction of travel and to permit movement of said head about said hinge pin in a second direction of travel, and, said shaft portions in alignment; and, a second operative position with said hinge members pivoted about said hinge pin (15), said shaft portions moved out of alignment, and said flat surfaces (19) (40) spaced apart from said shoulders (54) (21).

2. Golf apparatus including at least one club selected from the group consisting of a two iron, three iron, four iron, five iron, six iron, seven iron, eight iron, and nine iron, each iron including (a) a grip at the upper end thereof;

(b) a head at the lower end thereof provided with a face on its forward side, said face having a selected loft and including a lower ground engaging edge;

(c) a shaft having a longitudinal axis and interconnecting said grip and said head, said edge and said longitudinal axis generally lying in a common plane;

(d) a hinge interposed in said shaft, dividing said shaft into two portions, and including (i) a first hinge member, (ii) a second hinge member, and (iii) a hinge pin pivotally connecting said hinge members and at a selected angle with respect to said common plane;

said first hinge member being attached to one of said shaft portions and including an outer end spaced to one side of said hinge pin;

said second hinge member being attached to the other of said shaft portions and including a shoulder to said one side of said hinge pin and engageable with said outer end to prevent the pivotal movement of said head about said hinge pin in a first direction and to allow the pivotal movement of said head about said hinge pin in a second direction opposite said first direction;

said angle for said two iron being in the range of 0.5 to 1.5 degrees;

three iron being in the range of 0.5 to 2.0 degrees;

four iron being in the range of 1.5 to 2.5 degrees;

five iron being in the range of 1.7 to 3.5 degrees;

six iron being in the range of 2.5 to 5.5 degrees;

seven iron being in the range of 5.0 to 6.5 degrees;

eight iron being in the range of 6.0 to 8.5 degrees; and, nine iron being in the range of 8.0 to 10.5 degrees.

3. The golf apparatus of claim 2 wherein said apparatus includes each iron in said group.

4. A method for interposing a hinge mechanism in the shaft of each of a plurality of golf clubs including a two iron, three iron, four iron, five iron, six iron, seven iron, eight iron and nine iron, each golf club including a grip at the upper end thereof, a head at the lower end thereof provided with a face on its forward side, said face having a selected loft and including a lower ground engaging edge, a shaft having a longitudinal axis and interconnecting said grip and said head, said edge and said longitudinal axis generally lying in a common plane, said shaft including first and second separated portions, said first portion connected to and extending outwardly from said head and including a distal end spaced away from said head, said second portion including a distal end spaced away from said grip, said hinge mechanism including first and second hinge members and a hinge pin pivotally connecting said hinge members, said first hinge member being adapted to slidably rotatably engage said distal end of said first portion of said shaft and including an outer end to one side of said hinge pin, said second hinge member having a reference point thereon and being adapted to slidably rotatably engage said distal end of said second portion of said shaft, including a shoulder to one side of said hinge pin, and engageable with said outer end to prevent the pivotal movement of said head about said hinge pin in a first direction and to allow the pivotal movement of said head about said hinge pin in a second direction opposite said first direction, said method comprising the steps of (a) securing said first portion of said club in a fixed position;

(b) positioning a calibration tool adjacent said first portion, said tool including reference indicia indicating the angle of rotation from said common plane;

(c) slidably rotatably engaging said distal end of said first portion of said golf club with said first hinge member;

(d) rotating said first hinge member about said longitudinal axis of said first portion until said reference point on said first hinge member is aligned with a reference indicia on said calibration tool to position said hinge pin at a selected angle with respect to said common plane; and, (e) securing said first hinge member to said first portion;

said selected angle for said (f) two iron being in the range of 0.5 to 1.5 degrees;

(g) three iron being in the range of 0.5 to 2.0 degrees;

(h) four iron being in the range of 1.5 to 2.5 degrees;

(i) five iron being in the range of 1.7 to 3.5 degrees;

(j) six iron being in the range of 2.5 to 5.5 degrees;

(k) seven iron being int he range of 5.0 to 6.5 degrees;

(l) eight iron being in the range of 6.0 to 8.5 degrees; and, (m) nine iron being in the range of 8.0 to 10.5 degrees.

* * * * *